US011235362B2

(12) United States Patent
Andreatta et al.

(10) Patent No.: US 11,235,362 B2
(45) Date of Patent: Feb. 1, 2022

(54) METHOD TO ADJUST THE DRAWING ACTION ON A BAR AND CORRESPONDING DEVICE

(71) Applicant: DANIELI & C. OFFICINE MECCANICHE S.P.A., Buttrio (IT)

(72) Inventors: Daniele Andreatta, Borso del Grappa (IT); Fabio Flumian, Pramaggiore (IT)

(73) Assignee: DANTELI & C. OFFICINE MECCANICHE S.P.A., Buttrio (IT)

( * ) Notice: Subject to any disclaimer, the term of this patent is extended or adjusted under 35 U.S.C. 154(b) by 140 days.

(21) Appl. No.: 16/648,920

(22) PCT Filed: Sep. 24, 2018

(86) PCT No.: PCT/IT2018/050174
§ 371 (c)(1),
(2) Date: Mar. 19, 2020

(87) PCT Pub. No.: WO2019/058406
PCT Pub. Date: Mar. 28, 2019

(65) Prior Publication Data

US 2020/0282439 A1 Sep. 10, 2020

(30) Foreign Application Priority Data

Sep. 25, 2017 (IT) ..... 102017000107113

(51) Int. Cl.
*B21B 1/18* (2006.01)
*B21B 37/52* (2006.01)

(52) U.S. Cl.
CPC ..... *B21B 1/18* (2013.01); *B21B 37/52* (2013.01); *B21B 2265/06* (2013.01); *B21B 2275/04* (2013.01); *B21B 2275/12* (2013.01)

(58) Field of Classification Search
CPC ..... B21B 37/52; B21B 37/46; B21B 37/48; B21B 2275/12; B21B 2275/04; B21B 1/16; B21B 1/18; B21B 2265/06
See application file for complete search history.

(56) References Cited

U.S. PATENT DOCUMENTS 3,940,960 A * 3/1976 Tanifuji ..... B21B 37/52 72/14.4
4,408,470 A * 10/1983 Fromont ..... B21B 37/52 700/151

(Continued)

FOREIGN PATENT DOCUMENTS

JP S569010 A 1/1981
WO 92/00817 A1 1/1992

(Continued)

OTHER PUBLICATIONS

Int'l Search Report and Written Opinion dated Nov. 30, 2018 in Int'l Application No. PCT/IT2018/050174.

*Primary Examiner* — Gregory D Swiatocha
*Assistant Examiner* — Bobby Yeonjin Kim
(74) *Attorney, Agent, or Firm* — Panitch Schwarze Belisario & Nadel LLP

(57) ABSTRACT

A method to adjust the drawing action on a bar in a rolling and/or finishing train is provided, as well as an adjustment device associated with the train to implement the method. A metal product is made using the method.

6 Claims, 3 Drawing Sheets

(56) References Cited

U.S. PATENT DOCUMENTS 4,662,202 A * 5/1987 Lambert ..... B21B 37/52
700/151
4,942,543 A * 7/1990 Da Rio ..... B21B 37/52
700/122

FOREIGN PATENT DOCUMENTS

WO 2012/014026 A1 2/2012
WO 2013/121277 A1 8/2013

* cited by examiner

METHOD TO ADJUST THE DRAWING ACTION ON A BAR AND CORRESPONDING DEVICE

CROSS-REFERENCE TO RELATED APPLICATIONS

This application is a Section 371 of International Application No. PCT/IT2018/050174, filed Sep. 24, 2018, which was published in the English language on Mar. 28, 2019, under International Publication No. WO 2019/058406 A1, which claims priority under 35 U.S.C. § 119(b) to Italian Application No. 102017000107113, filed Sep. 25, 2017, the disclosures of each of which are incorporated by reference herein in their entirety.

FIELD OF THE INVENTION

Embodiments of the present invention concern a method to adjust the inter-stand drawing action on a bar, a corresponding inter-stand adjustment device, and also a metal product obtained using said method.

By way of non-restrictive example, the present invention can be used in a rolling and/or finishing process of a bar to adjust the drawing action, on each occasion, imparted to the latter, so as to prevent the formation of critical zones and/or deformations in the bar itself.

The present invention can also be used in hot, cold, dry, or other drawing plants.

BACKGROUND OF THE INVENTION

One of the problems encountered in rolling and/or finishing processes of a product, by way of non-restrictive example, a metal product in the form of a bar, is connected to the need to subject the bar to a specific and controlled inter-stand drawing action.

By the term stands we mean rolling stands, cold or hot finishing stands, or drawing systems, for example of the dry type, or systems in line with a casting plant, or other.

Hereafter, for simplicity of exposition, reference will be made to the stands of rolling and/or finishing trains.

It is known that in order to obtain a final product with desired specific characteristics, it is necessary to adjust the operating parameters of the individual stands of the rolling train so as to correctly define the drawing action on the bar between one stand and the other.

This adjustment is applied during the passage of the bar in two successive stands, so that the torques of the drive members, acting on the rolls of the individual stands affecting the bar, are substantially equal to predefined reference torque values.

It is known that the predefined reference torque values do not consider the specific and precise operating conditions of the individual stands on the specific bar.

This can lead to a production with non-homogeneous qualitative factors that are important in the final product and sometimes cause the need to discard a large quantity of product.

Some known methods provide to start the adjustment of the torque of the drive members of the individual stands in a consequential manner, when the leading end of the bar has exited from the individual stand.

This known solution means that the bar is subjected to repeated adjustments which can easily be differentiated with respect to the specific need to bring the individual torque values of the stands to the corresponding reference torque values.

These adjustments generate consequential stresses which, every time the bar transits in the next stand, alter the values, even abruptly, of the torques of the previous stands, which values are adjusted again.

This can generate deformations and/or neckings and/or markings on the bar that can negatively affect the quality of the final product which will have insufficient qualitative, morphological and structural characteristics.

A plurality of methods and devices for managing the inter-stand drawing action are known, which have given partial and not always satisfactory results, in particular in terms of precision, constancy and quality of results.

Since the known solutions are slow, as they require significant inter-stand crossing times, for example at least one second, they can be applied only in cases where the bars have maximum sizes of their cross section, or diameters, greater than 40 mm.

This temporal limitation, in cases where it is not possible to increase the speed of feed of the bar, means that the plant itself requires big spaces to distance the stands so that the inter-stand times are greater than one second.

There is therefore a need to perfect and make available a method to adjust the inter-stand drawing action exerted on the individual bar, as well as a corresponding adjustment device, which overcome at least one of the disadvantages of the state of the art.

The purpose of the present invention is to provide a method able to efficiently adjust the torque of the motors of the individual stands to obtain a final product having characteristics that come within a desired tolerance.

The invention also tends to neutralize the variations, more or less continuous, of the torque value of each stand.

Another purpose of the present invention is to provide a method suitable to adjust the torque of the motors of the individual stands in relation to reference torque values correlated to the specific and precise operating conditions of the individual stands, said torque values also being conditioned by the characteristics of the specific bar.

Another purpose of the present invention is to provide a method able to rapidly adjust the torques of the motors of the individual stands so that the bulk of the rolling train, and therefore of the production line as a whole, is limited.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

Embodiments described here concern a method to adjust the drawing action on a bar in a rolling and/or finishing train to obtain a final desired product.

The method is applicable to trains comprising a plurality of stands configured to be driven by respective drive members and to define a feed path for the bar, said stands being equipped with cylinders or rolls.

Hereafter, for simplicity of exposition, reference will be made to stands with rolls, but the term also includes stands with cylinders.

The adjustment method also provides at least a step of setting the operating parameters and a step of adjusting the operating parameters of the individual stands to obtain the desired final product, said parameters being acquired with acquisition means present in the train or associated with one or more components of the individual stands.

In accordance with one aspect of the present invention, the setting step provides to determine the reference torque values of each stand during the feed of the initial segment of the specific bar and in relation to the final product to be obtained.

According to possible embodiments, the adjustment step provides to adjust the tangential speeds of the rolls of the individual stands in order to take the torque values of each stand to the reference torque values defined in the setting step, and to maintain them there.

According to possible embodiments, the adjustment step is started after a leading end of the bar has exited from the last stand.

By leading end of the bar we mean the first end that transits through the rolling train.

According to possible embodiments, the reference torque values of the stands are deter mined sequentially.

In accordance with possible solutions the reference torque value of the i-th stand is determined after the leading end of the bar exits from the i-th stand.

In accordance with possible solutions, the reference torque value of said i-th stand is calculated by subtracting from the total torque value of the stands, after the leading end of the bar has exited from the i-th stand, the total torque value of the stands before the leading end of the bar has entered the i-th stand.

According to possible variant embodiments, the total torque value of the stands is calculated by adding the mean values of at least part of the torque values of the individual stands up to the stand from which the leading end of the bar has exited.

In accordance with possible variant solutions, the mean torque value of the i-th stand is calculated by averaging the torque values after the leading end of the bar has exceeded half the distance between the i-th stand and the next stand.

According to possible solutions, the adjustment step provides to adjust the operating parameters of the stands, maintaining the inter-stand drawing action of the bar at a desired value.

It comes within the spirit of the invention to provide an inter-stand adjustment method and a metal product obtained using said method.

Formulations of the present invention also concern an adjustment device to adjust the inter-stand drawing action on a bar configured to implement a method to adjust the inter-stand drawing action on a bar as in one of the embodiments.

The adjustment device is provided with suitable management, processing and command units, functionally associated with each other to manage the functioning of the components of the rolling and/or finishing train.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
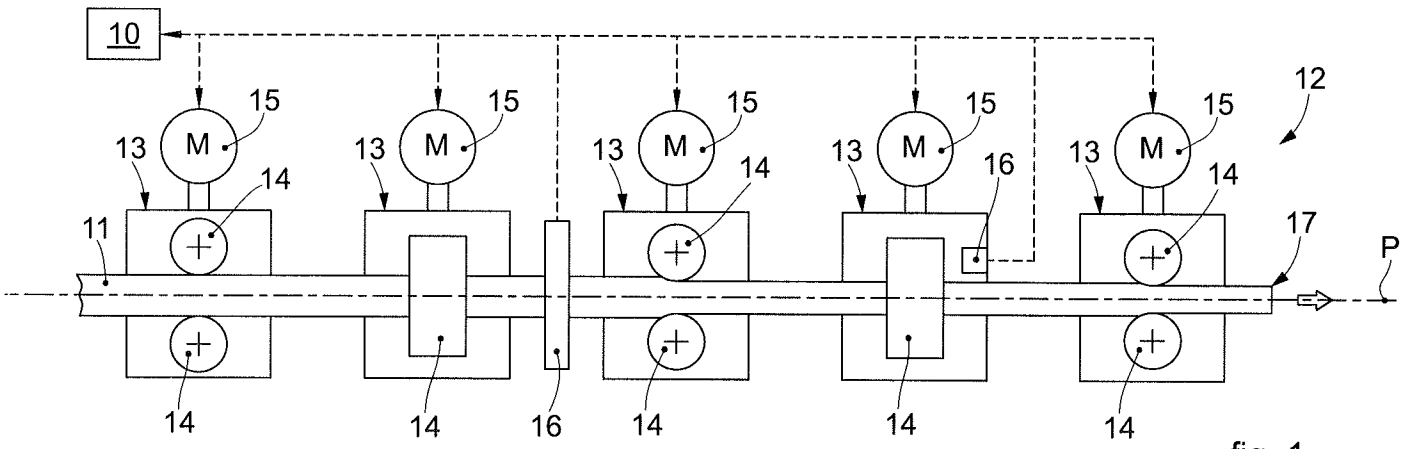
FIG. 1 is a schematic representation of a rolling train for a bar, provided with an adjustment device as in one of the embodiments described.
Figure 2:
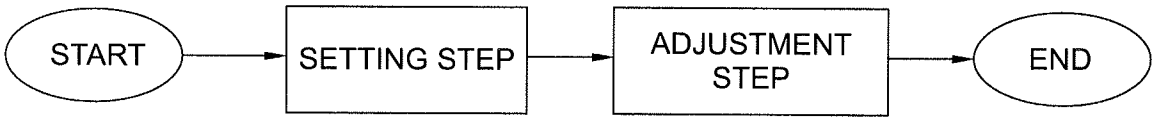
FIG. 2 is a block diagram of an adjustment method as in one of the embodiments described.
Figure 3:
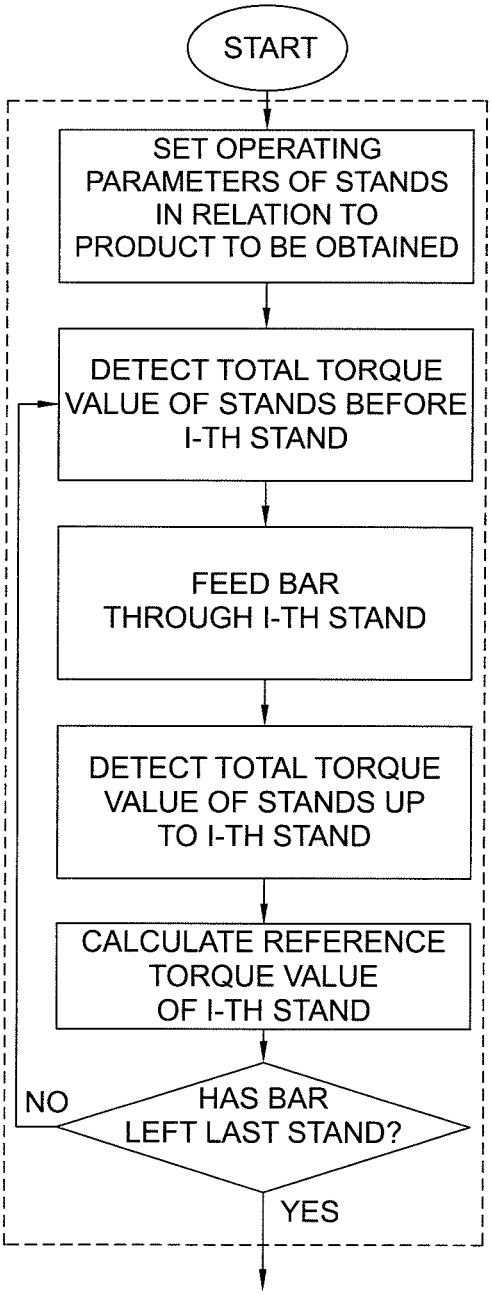
FIGS. 3 and 4 show possible operating sequences of the diagram in FIG. 2.
Figure 4:
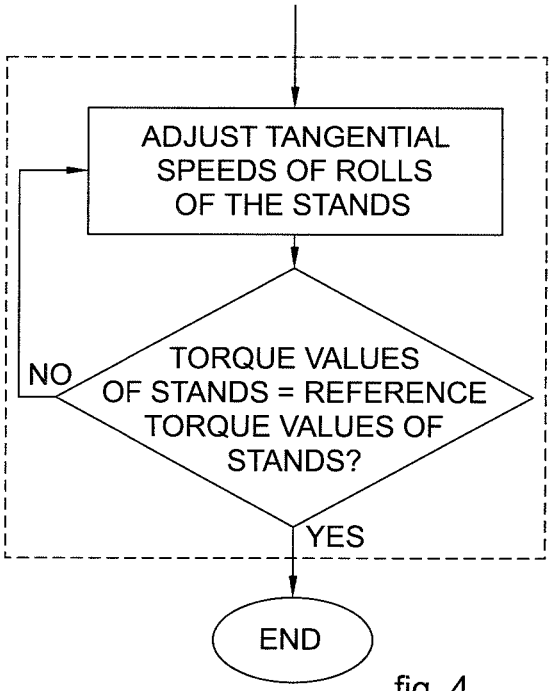

Embodiments described here, with reference to the attached drawings, concern a method to adjust the inter-stand drawing action exerted on a bar 11 in a rolling and/or finishing train 12 to obtain a final product having the desired dimensional, morphological and structural characteristics.

The train 12 can comprise a plurality of stands 13 provided with rolls 14 configured to be driven by respective drive members 15 and to define a feed path P for the bar 11.

Here and hereafter in the description, the term bar 11 also refers to other metal products such as billets, rod, or other. The bars 11 can come from casting lines, reheating furnaces, storage warehouses, or other.

Advantageously, the present invention is effective for adjusting the drawing action on a bar 11 in which the cross-section has a maximum size greater than or equal to 20 mm.

The present invention is also effective and efficient in trains 12 in which the inter-stand feed times of the bar 11 are equal to or less than one second.

This also allows to reduce the bulk of the train 12 since, in order to obtain these inter-stand feed times, it is possible to minimize the distance D between the stands 13 acting on the feed speeds of the bar 11 along the path P.

The adjustment method provides at least one step of setting the reference operating parameters and a step of adjusting the operating parameters of the individual stands 13 to obtain the desired final product.

The adjustment step provides to adjust the operating parameters of the individual stands 13 so that the latter are substantially equal to the reference operating parameters defined in the setting step.

The adjustment can be performed with a proportional-integral PI adjustment algorithm in relation to which the drive members 15 are commanded.

The operating parameters, at least initially, can be set in relation to the product to be produced.

For example, the operating parameters can comprise the torque of the individual drive members 15, the electric supply current of the drive members 15, the distance between the rolls 14 of the individual stands 13, the drawing action on the bar 11 between one pair of stands 13.

The operating parameters can also comprise parameters relating to the bar 11, such as for example the cross-section, the feed speed, the temperature, or other.

The operating parameters can be acquired with acquisition means 16 present in the train 12 or associated with one or more components of the individual stands 13.

For example, the acquisition means 16 can comprise sensors associated with the individual drive members 15, sensors disposed at the entrance and/or exit of the individual stands 13, sensors located between a pair of stands 13, or other.

According to possible embodiments, the sensors can acquire one or more operating parameters.

According to one aspect of the present invention, the setting step provides to determine the reference torque values of each stand 13 during the feed of the initial segment of the specific bar 11 and in relation to the final product to be obtained.

According to possible embodiments, the adjustment step provides to adjust at least the tangential speeds of the rolls 14 of the stands 13, in order to take the torque values of each stand 13 to the reference torque values defined in the setting step, and to maintain them there.

According to possible embodiments, the adjustment step is started after the leading end 17 of the bar 11 has exited from the last stand 13.

According to possible embodiments, the reference torque values of the stands 13 are defined sequentially.

In accordance with possible solutions, the reference torque value of the i-th stand Gi is determined after the leading end 17 of the bar 11 exits from the i-th stand Gi.

Applicant has verified that the train 12, in stationary conditions, substantially preserves the total power supplied to the drive members 15 of the stands 13.

By stationary conditions we mean the conditions that are present when the bar 11 is being rolled, except for the transients during the entry of the leading end or during the exit of the tail end of the bar 11 in each stand 13.

It has also been verified that the preservation of the total power supplied to the drive members 15 also entails the preservation of the total torque of the drive members 15 of the stands 13 in which the bar 11 transits.

The drawing power of the i-th stand Gi can be expressed as the difference between the product of the drawing force between the i-th stand Gi and the previous stand Gi−1 with the speed of the bar entering the i-th stand Gi, and the product of the drawing force between the i-th stand Gi and the following stand Gi+1 with the speed of the bar exiting the i-th stand Gi.

The drawing force between the i-th stand Gi and the previous stand Gi−1 is given by the product of the entrance section of the bar 11 in the i-th stand Gi with the specific tension of the bar 11 entering the i-th stand Gi.

The total drawing power of the stands 13 is given by the sum of the drawing powers from the first to the last stand 13 of the train 12.

The total power of the train 12 is given by the sum of the total drawing power of the stands 13, the powers of the stands 13 to deform the bar 11 and the powers dissipated by the gears and bearings of the stands 13.

Applicant has verified that, under stationary conditions, the total power of the train 12 is substantially independent of inter-stand tensions.

This means that the total drawing power is negligible compared to the powers of the stands 13 to deform the bar 11.

Since the powers of the stands 13 to deform the bar 11 are substantially constant, therefore the total power and the total torque of the stands 13 are also constant.

These considerations allow to determine the reference torque values of each stand 13 during the feed of the initial segment of the specific bar 11.

In accordance with possible solutions, the reference torque value of the i-th stand Gi is calculated by subtracting from the value of the total torque of the stands 13, after the leading end 17 of the bar 11 has exited from the i-th stand Gi, the total torque value of the stands 13 before the leading end 17 of the bar 11 has entered the i-th stand Gi.

Figure 5A:
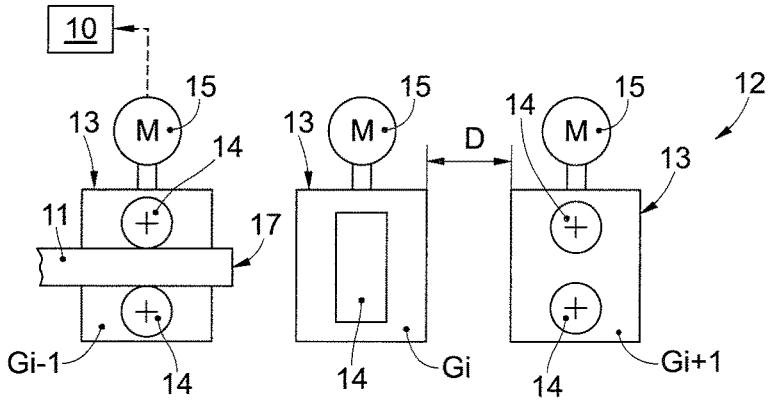
FIGS. 5*a*-5*d* show schematically a rolling and/or finishing train for a bar during the actuation of an adjustment method as in one of the embodiments described.
Figure 5B:
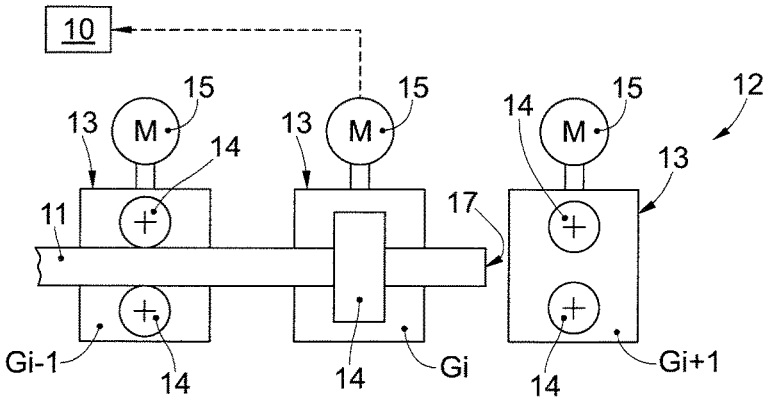
Figure 5C:
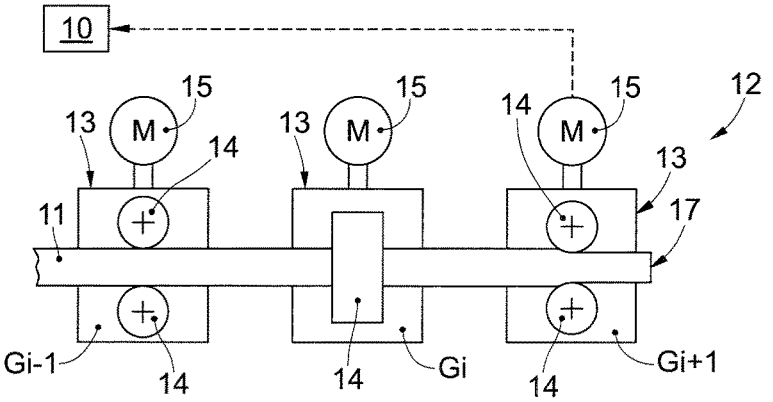
Figure 5D:
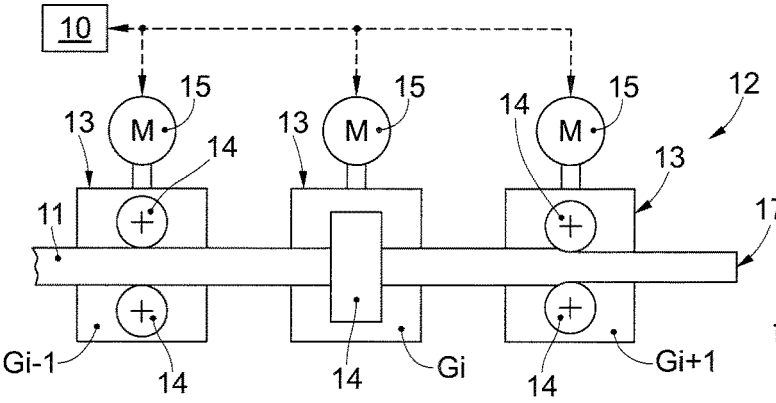

For example, the reference torque value of the third stand 13 shown in FIGS. 5*a*-5*d* is calculated by subtracting from the total torque value of the three stands 13 the total torque value of the first and second stands 13.

According to possible variant embodiments, the total torque value of the stands 13 is calculated by summing the mean values of at least part of the torque values of the individual stands 13 up to the stand 13 from which the leading end 17 of the bar 11 has exited.

The torque values of the i-th stand Gi with which the mean values are calculated can comprise, for example, but not limitedly, the last ten torque values before the leading end 17 enters the next stand Gi+1.

In accordance with possible variant solutions, the mean torque value of the i-th stand Gi is calculated by averaging the torque values after the leading end 17 of the bar 11 has exceeded half the distance D between the i-th stand Gi and the next stand Gi+1.

In accordance with possible embodiments, the setting step can provide to verify whether the absolute value of the difference of each of the reference torque values of the stands 13 with the mean torque value of the corresponding stand 13 is higher than a predefined threshold value.

If this last condition occurs, the method provides to signal this condition to an operator and/or to command one or more of the components of the stands 13 so that the absolute value of the difference is lower than the predefined threshold value.

According to possible solutions, the adjustment step provides to adjust the operating parameters of the stands 13 while maintaining the inter-stand drawing action on the bar 11 at a desired value.

Formulations of the present invention also concern an adjustment device 10 of the inter-stand drawing action on a bar 11 configured to implement a method to adjust the inter-stand drawing action on a bar 11 as in one of the embodiments.

It is clear that modifications and/or additions of parts can be made to the adjustment method, the adjustment device 10 and the product obtain using this method as described heretofore, without departing from the field and scope of the present invention.

It is also clear that, although the present invention has been described with reference to some specific examples, a person of skill in the art shall certainly be able to achieve many other equivalent forms of adjustment method and corresponding adjustment device 10, having the characteristics as set forth in the claims and hence all coming within the field of protection defined thereby.

The invention claimed is:

1. A method to adjust the drawing action on a bar (11) in a rolling and/or finishing train (12) to obtain a final product, said train (12) comprising a plurality of stands (13) provided with rolls (14) configured to be driven by respective drive members (15) with a desired torque value and to define a feed path (P) for said bar (11), said adjustment method providing at least a step of setting operating parameters of said stands (13) and a step of adjusting said operating parameters to obtain said final product, said parameters being acquired with acquisition means (16) present in said train (12) or associated with one or more components of said stands (13), wherein said setting step provides to determine a reference torque value of each of said stands (13) during the feed of an initial segment of said bar (11) and in relation to said final product to be obtained, and wherein said adjustment step is started after a leading end (17) of said bar (11) has exited from the last of said stands (13), wherein said reference torque value of the i-th stand (Gi) is determined after a leading end (17) of said bar (11) exits from said i-th stand (Gi), and wherein said reference torque value of said i-th stand (Gi) is calculated by subtracting from the total torque value of said stands (13), after said leading end (17) of said bar (11) has exited from said i-th stand (Gi), the total torque value of said stands (Gi) before said leading end (17) of said bar (11) has entered said i-th stand (Gi).

2. The method as in claim 1, wherein determining said reference torque values of each of said stands (13) is preceded by detecting the torque values of said stands (13) in which said bar (11) is present.

3. The method as in claim 1, wherein said reference torque values of said stands (13) are determined sequentially.

4. The method as in claim 1, wherein said total torque value of said stands (13) is calculated by adding the mean values of at least part of said torque values of said stands (13) up to the stand (13) from which said leading end (17) of said bar (11) has exited.

5. The method as in claim 1, wherein said adjustment step provides to adjust the tangential speeds of said rolls (14) of said stands (13) so as to take said torque values of each of said stands (13) to said reference torque values.

6. The method as in claim 1, wherein said adjustment step provides to adjust said operating parameters of said stands (13), maintaining the inter-stand drawing action of said bar (11) at a desired value.

* * * * *